US006758773B1

(12) United States Patent
Liao et al.

(10) Patent No.: US 6,758,773 B1
(45) Date of Patent: Jul. 6, 2004

(54) FLASHING DART

(75) Inventors: Yen-Hwa Liao, Taichung (TW); Wen-Fu Chang, Taichung (TW); Chun-Hung Liu, Tali (TW)

(73) Assignee: Forhouse Corporation, Taichung Hsien (TW)

( * ) Notice: Subject to any disclaimer, the term of this patent is extended or adjusted under 35 U.S.C. 154(b) by 0 days.

(21) Appl. No.: 10/689,048

(22) Filed: Oct. 21, 2003

(51) Int. Cl.[7] ..... A63B 65/02
(52) U.S. Cl. ..... 473/578; 473/570
(58) Field of Search ..... 473/570, 578

(56) References Cited

U.S. PATENT DOCUMENTS 4,340,930 A * 7/1982 Carissimi ..... 362/204
4,989,881 A * 2/1991 Gamble ..... 473/570
5,058,900 A * 10/1991 Denen ..... 473/570
5,134,552 A * 7/1992 Call et al. ..... 362/203
5,425,542 A * 6/1995 Blackwood et al. ..... 473/570
6,123,631 A * 9/2000 Ginder ..... 473/570
6,533,688 B1 * 3/2003 Huang ..... 473/578
6,666,782 B1 * 12/2003 Wu ..... 473/570

* cited by examiner

*Primary Examiner*—John A. Ricci
(74) *Attorney, Agent, or Firm*—Dennison, Schultz, Dougherty & MacDonald

(57) ABSTRACT

A flashing dart has a hollow barrel, a point assembly, a transparent shaft, a circuit board, a battery and a resilient element. The barrel has a front end and a rear end and is made of conductive material. The point assembly is attached to the front end of the barrel. The transparent flight shaft is attached to the rear end of the barrel. The circuit board has an integrated circuit controller and is firmly mounted inside the barrel. The battery has two electrodes connected respectively to the barrel and the circuit board. The resilient element abuts the battery and allows the battery to be temporarily disconnected from the circuit board when the flashing dart strikes a dartboard or is thrown thereby activating the integrated circuit controller that causes the lighting element to emit light for a preset period of time.

8 Claims, 4 Drawing Sheets

FLASHING DART

BACKGROUND OF THE INVENTION

1. Field of the Invention

The invention relates to a dart, and particularly to a dart that flashes light for a period of time when the dart strikes a dartboard.

2. Description of Related Art

Throwing darts is a leisure activity that is entertaining and competitive so throwing darts is popular. A player throws a dart at a dartboard that has multiple areas representing different points. The player scores points corresponding to the points assigned to the area on the dartboard in which the dart strikes. Players may compete head-to-head, or teams of players may compete with other teams.

Conventional darts simply consist of a barrel with two ends, a point attached to one end of the barrel and a shaft with a tail attached to the other end of the barrel, and a flight attached to the tail of the shaft to provide stability to the whole dart. Therefore, conventional darts do not have any extra features such as light or sound when the dart strikes the dartboard.

With reference to FIG. 6, a conventional flashing dart was invented to create more fun in a dart game. The conventional flashing dart is composed a hollow barrel (30), a battery (36), a point (32), a lighting element (34), a transparent shaft (38) and a stabilizing flight (39). The hollow barrel (30) has a front end (not numbered) and a rear end (not numbered). The battery (36) is mounted inside the barrel (30). The point (32) retractably mounted on the front end of the barrel (30). The lighting element (34) is embedded in the rear end of the barrel (30). The transparent shaft (38) with a distal end is attached to the rear end of the barrel (30). The stabilizing flight (39) is attached to the distal end of the shaft (38).

The barrel (30) is made of conductive material and has a channel (not numbered) axially defined through the barrel (30). The battery (36) is mounted inside the channel and has one electrode (not numbered) connected to the lighting element (34) and the other electrode (not numbered) operationally connected to the point (32). The lighting element (34) connected to the battery (36) inside the channel is further in electrical contact with the barrel (30). The point (32) protruding from the barrel (30) is also in electrical contact with the barrel (30) and has a coil spring (33) mounted around part of the point (32) inside the channel to provide a restitution force to the point (32).

When the conventional flashing dart is thrown, the dart acquires momentum. When the dart hits the dartboard, the dart's momentum compresses the coil spring (33) and causes the point (32) to be pushed into the hollow barrel (30) and make contact with the electrode of the battery (36). With the point (32) in contact with the electrode, an electrical circuit is closed and turns on the lighting element (34). When the dart's momentum dissipates, the coil spring (33) pushes the point (32) back to an original, position thereby breaking the electrical circuit to save electrical power.

However, the conventional flashing dart only lights up very briefly when the point (32) contacts with the battery (36). The flash of the flashing dart does not persist and is not attractive enough for players.

The present invention has arisen to provide a flashing dart to obviate the drawbacks of the conventional flashing dart.

SUMMARY OF THE INVENTION

A first objective of the present invention is to provide a flashing dart that is activated by inertia force.

A second objective of the present invention is to provide a flashing dart that emits lights for a preset period of time.

Further benefits and advantages of the present invention will become apparent after a careful reading of the detailed description in accordance with the drawings.

DETAILED DESCRIPTION OF THE PREFERRED EMBODIMENT

Figure 1:
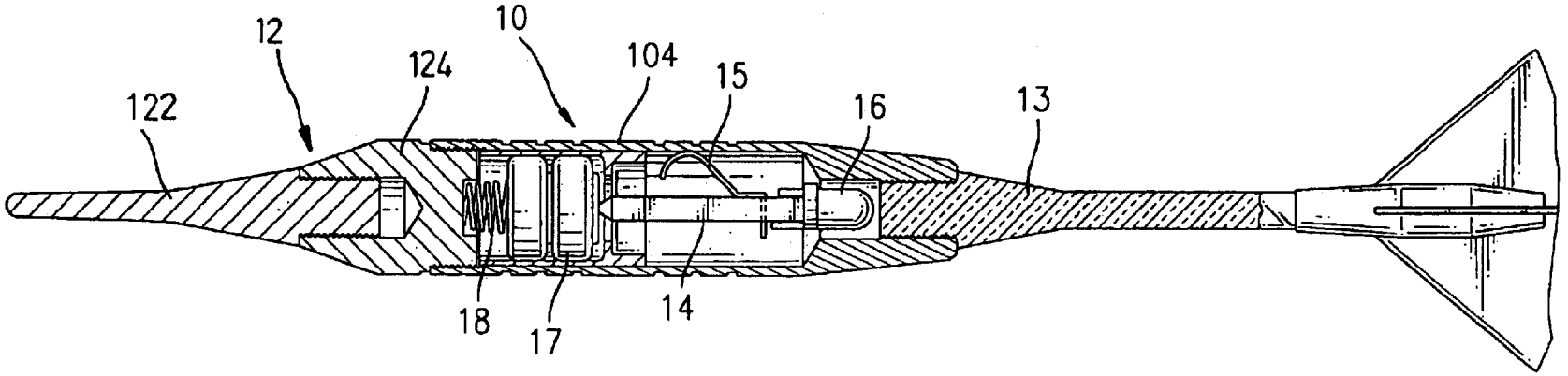
FIG. 1 is a partially cross-sectional view of a flashing dart in accordance with the present invention.

With reference to FIG. 1, a flashing dart in accordance with the present invention comprises a barrel (10), a point assembly (12), a transparent shaft (13), a circuit board (14), a lighting element (16), a battery (17) and a resilient element (18).

The barrel (10) is hollow, is made of conductive material and has a front end (not numbered) and a rear end (not numbered). The front and rear ends of the barrel (10) have internal threads (not numbered).

The point assembly (12), partially or wholly made of conductive material, has a point (122) and a point plug (124). The point (122) is attached axially to the point plug (124) and may be either conductive or non-conductive material. The point plug (124) is made of conductive material and has a front end (riot numbered) and a rear end (not numbered). The rear end has an external annular thread (not numbered) that screws into the internal thread at the front end of the barrel (10). The front end of the point plug (124) has an axial hole (not numbered) with an internal thread (not numbered). The point (122) is screwed into the internal thread of the point plug (124) in the axial hole in the point plug (124).

The transparent shaft (13) is screwed into the internal thread at the rear end of the barrel (10). The transparent shaft (13) further has a tailing end (not numbered) and a stabilizing flight (not numbered) attached to the tailing end.

Figure 2:
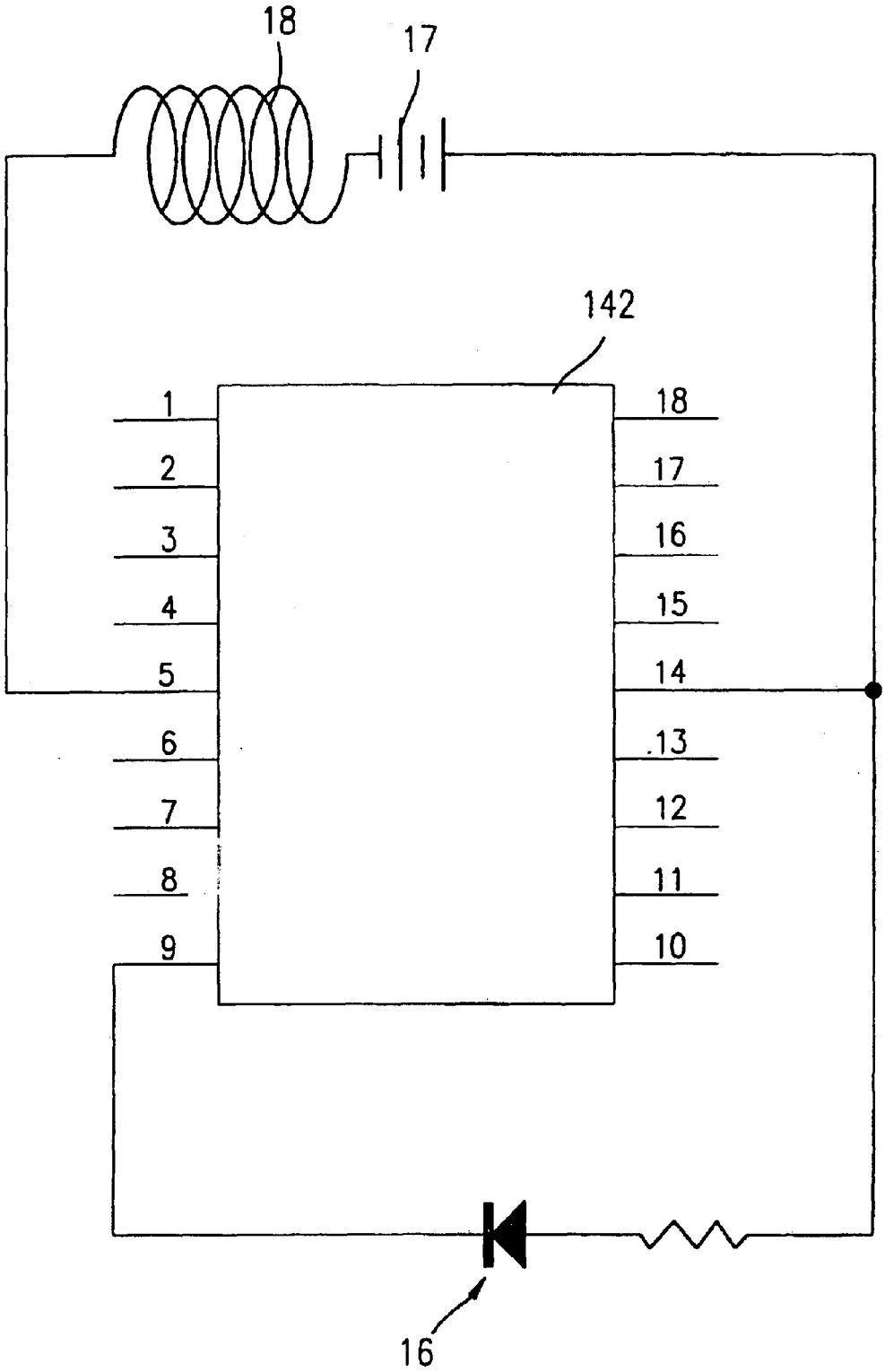
FIG. 2 is a schematic circuit diagram of an electrical circuit used in the flashing dart in FIG. 1.

With further reference to FIG. 2, the circuit board (14) is mounted inside the barrel (10) and has an integrated circuit controller (142) mounted on the circuit board (14). The battery (17) is mounted movably inside the barrel (10) and has two electrodes (not shown). One electrode of the battery (17) is directly and electrically connected to the integrated circuit (14), and the other electrode is connected electrically to the barrel (10) by abutting the resilient element (18) mounted between the battery (17) and the point plug (124). The circuit board (14) further connects to the lighting element (16) that is mounted close to the transparent shaft (13) and has a resilient conductive arm (15) extending from the circuit board (14) to make electrical contact with the barrel (10). Thereby, an electrical circuit in the flashing dart is completed.

Additionally, the resilient element (18) is preferred to be a spring and the lighting element (16) is preferred to be a Light Emitting Diode (LED).

When the flashing dart is not in action, the battery (17) abuts the circuit board (14) but the IC controller (142) is dormant. Therefore, electricity does not pass to the lighting element (16) and thus saving electricity.

Figure 3:
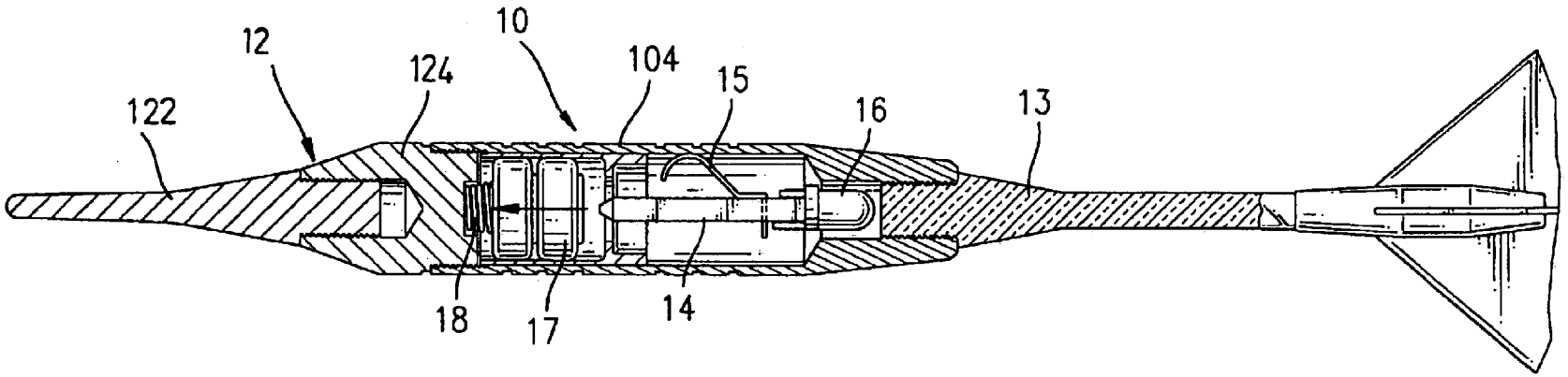
FIG. 3 is a partially cross-sectional view of the flashing dart as in FIG. 1, showing the flashing dart is in action when just strikes a dartboard.

When a player throws the flashing dart, all elements of the flashing dart acquire momentum. With reference to FIG. 3, the battery (17) moves toward the front end of the barrel (10) when the flashing dart strikes a dartboard because the momentum in fixed elements of the flashing dart are stopped quickly by the resistive force of the dartboard and the momentum of the battery (17) is dissipated slower due to the resilient element (18). Consequently, the battery (17) temporarily detaches from the circuit board (14), and power to the integrated circuit controller (142) is cut off. However, a restitution force stored in the resilient element (18) when battery (17) moves forward and compresses the resilient element (18) causes the battery (17) to move back and make contact with the circuit board (14) again. Thereby, the electrical circuit is closed again, and the circuit board (14) transmits a signal to reset the integrated circuit controller (142). Upon receipt of the signal, the integrated circuit controller (142) provides power to the lighting element (16) and causes the lighting element (16) to emit light for a specific period of time. At the end of the specific period of time, the integrated circuit controller (142) shuts off power to the lighting element (16) and becomes dormant to save electricity. Additionally, the integrated circuit controller (142) can control flashing, blinking and color variation features of the lighting element (16).

Figure 4:
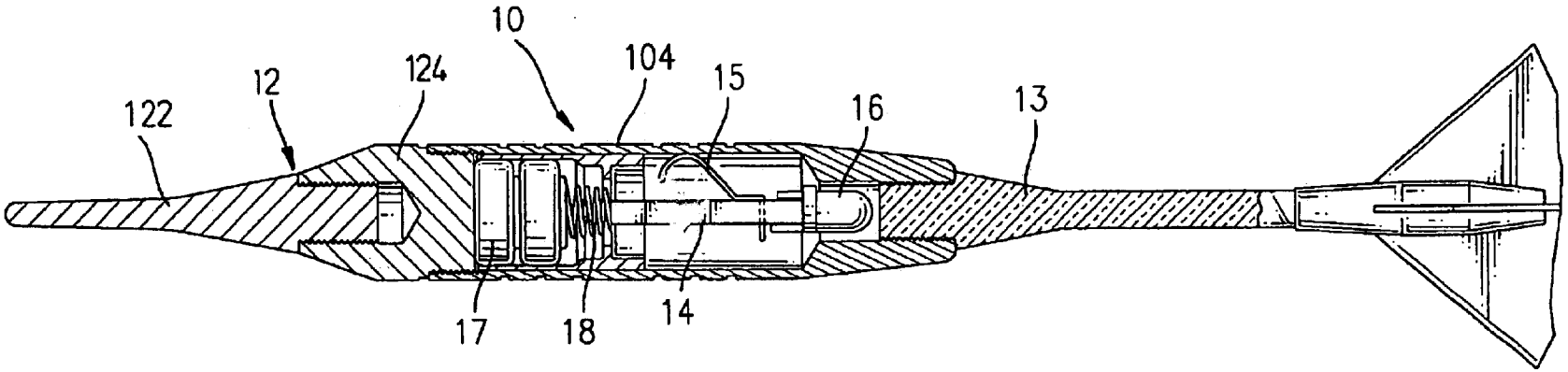
FIG. 4 is a partially cross-sectional view of another embodiment of the flashing dart in accordance with the present invention.
Figure 5:
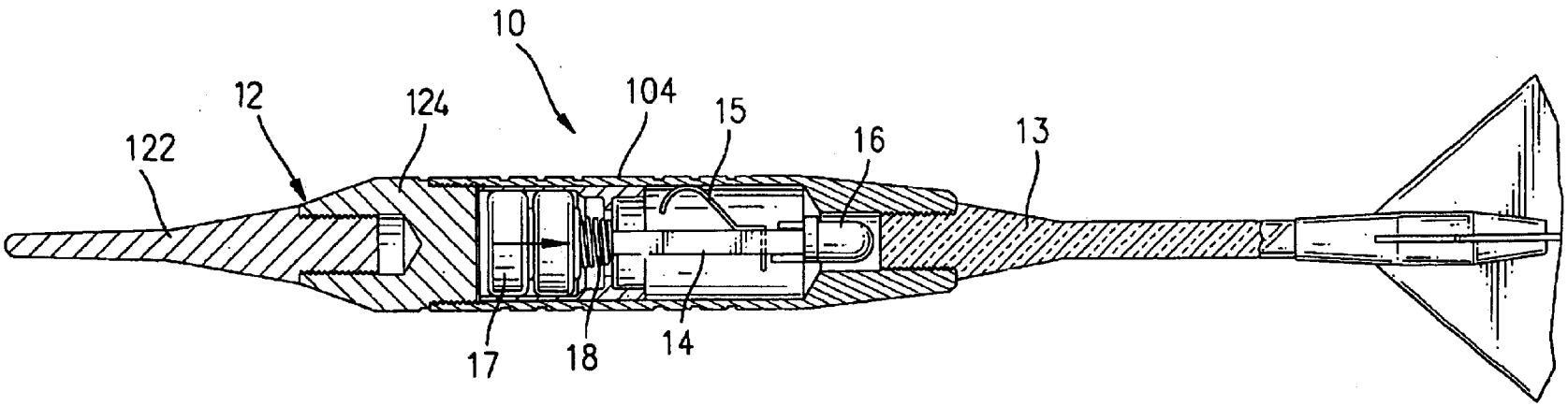
FIG. 5 is a partial cross-sectional view of the flashing dart as in FIG. 4, showing the flashing dart is in action when just strikes a dartboard.
Figure 6:
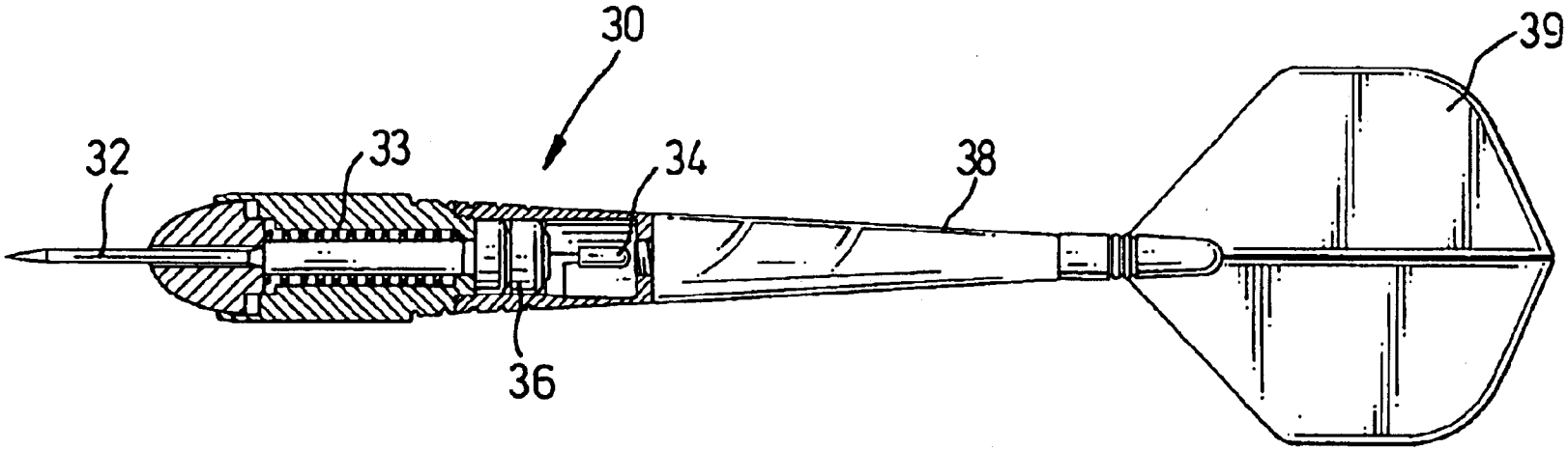
FIG. 6 PRIOR ART
FIG. 6 is a partially cross-sectional view of a conventional flashing dart in accordance with the prior art.

Further with reference to FIGS. 4 and 5, another embodiment of the flashing dart has the resilient element (18) mounted between the battery (17) and the integrated circuit board (14). In a steady-state condition, the resilient element (18) presses the battery (17) against the point plug (124). When the flashing dart is thrown initially, the inertia of the battery (17) causes the battery (17) to compress the resilient element (18) and temporarily separate from the point plug (124). When the resilient element (18) presses the battery (18) against the point plug (124) again, the electrical circuit is closed, and the integrated circuit controller (142), which previously was in dormant, is activated again and makes the flashing dart emit light for a specific period of time.

According to foregoing description, the flashing dart in accordance with the present invention emits lights for a specific period of time or further has more entertaining features such as blinking or color variations to make the flashing dart interesting and attractive.

Although the invention has been explained in relation to its preferred embodiment, many other possible modifications and variations can be made without departing from the spirit and scope of the invention as hereinafter claimed.

What is claimed is:

1. A flashing dart comprising:

a hollow barrel (10) having a front end and a rear end, and made of conductive material;

a point assembly (12) attached to the front end of the barrel (10) and partially made of conductive material;

a transparent shaft (13) attached to the rear end of the barrel (10), a circuit board (14) having an integrated circuit controller (142) electrically connected to the barrel (10) and being mounted inside the barrel (10);

a lighting element (16) electrically connected to the circuit board (14) and mounted inside the barrel (10) close to the transparent flight shaft (13);

a battery (17) mounted movably inside the barrel (10) and electrically connected to the circuit board (14); and a resilient element (18) mounted inside the barrel (10) and abutting the battery (17) to provide a restitution force to the battery (17).

2. The flashing dart as claimed in claim 1, wherein the barrel (10) has an internal thread defined in the front end;

the barrel (10) has an internal thread defined in the rear end;

the point assembly (12) is composed of a point plug (124) and a point (122);

wherein the point plug (124) is made of conductive material and has a front end having an axial hole with an internal thread and a rear end with an external annular thread that screws into the internal thread at the front end of the barrel (10); and the point (122) is screwed into the internal thread in the axial hole in the point plug (124).

3. The flashing dart as claimed in claim 2, wherein the resilient element (18) is mounted between the point plug (124) and the battery (17).

4. The flashing dart as claimed in claim 3, wherein the circuit board (14) further has a conductive arm (15) extending from the circuit board (14) to make electrical contact with the barrel (10).

5. The flashing dart as claimed in claim 2, wherein the resilient element (18) is mounted between the battery (17) and the circuit board (14).

6. The flashing dart as claimed in claim 5, wherein the circuit board (14) further has a conductive arm (15) extending from the circuit board (14) to make electrical contact with the barrel (10).

7. The flashing dart as claimed in claim 1 wherein the lighting element is a Light Emitting Diode.

8. The flashing dart as claimed in claim 1, wherein the point assembly (12) is wholly made of conductive material.

* * * * *